US012523405B2

(12) United States Patent
Mukherjee et al.

(10) Patent No.: US 12,523,405 B2
(45) Date of Patent: Jan. 13, 2026

(54) SYSTEM AND METHOD FOR CONTROLLING HEAD PRESSURE IN A REFRIGERATION SYSTEM

(71) Applicant: Lennox Industries Inc., Richardson, TX (US)

(72) Inventors: Arijit Mukherjee, Kalyani (IN); Sangameshwaran Sadhasivam, Kanchipuram (IN)

(73) Assignee: Lennox Industries Inc., Richardson, TX (US)

( * ) Notice: Subject to any disclaimer, the term of this patent is extended or adjusted under 35 U.S.C. 154(b) by 101 days.

(21) Appl. No.: 18/635,417

(22) Filed: Apr. 15, 2024

(65) Prior Publication Data

US 2025/0321036 A1 Oct. 16, 2025

(51) Int. Cl.
*F25B 49/02* (2006.01)
*F25B 41/20* (2021.01)

(52) U.S. Cl.
CPC ..... *F25B 49/027* (2013.01); *F25B 41/20* (2021.01); *F25B 2400/05* (2013.01); *F25B 2500/31* (2013.01); *F25B 2600/17* (2013.01); *F25B 2600/2507* (2013.01); *F25B 2600/2513* (2013.01); *F25B 2600/2517* (2013.01); *F25B 2700/195* (2013.01); *F25B 2700/2106* (2013.01)

(58) Field of Classification Search
CPC .... F25B 41/20; F25B 49/027; F25B 2400/05; F25B 2400/053; F25B 2500/31; F25B 2600/17; F25B 2600/2507; F25B 2600/2513; F25B 2600/2517; F25B 2700/195; F25B 2700/2106
See application file for complete search history.

(56) References Cited

U.S. PATENT DOCUMENTS

2019/0338991 A1* 11/2019 Hagler ..... F25B 40/02

* cited by examiner

*Primary Examiner* — Jonathan Bradford
(74) *Attorney, Agent, or Firm* — Baker Botts L.L.P.

(57) ABSTRACT

A refrigeration system comprises a compressor, a condenser, a receiver tank, an evaporator and a heat exchanger. The heat exchanger comprises an inlet positioned downstream of the receiver tank and an inlet positioned downstream of the compressor. The heat exchanger is configured to transfer heat between refrigerant received from the compressor and refrigerant received from the receiver tank, wherein a transfer of heat causes at least a portion of the refrigerant received from the receiver tank to transition from liquid to vapor. This process propels the head pressure of the compressor to increase to compensate for low ambient conditions. The heat exchanger comprises a first outlet in fluid communication with the first inlet, the first outlet configured to dispense the vapor refrigerant toward the receiver tank, and a second outlet in fluid communication with the second inlet and configured to dispense the refrigerant received from the compressor toward the condenser.

20 Claims, 3 Drawing Sheets

SYSTEM AND METHOD FOR CONTROLLING HEAD PRESSURE IN A REFRIGERATION SYSTEM

TECHNICAL FIELD

This disclosure relates generally to refrigeration systems. More particularly, this disclosure relates to a system and method for controlling head pressure in a refrigeration system.

BACKGROUND

Refrigeration systems are used to regulate environmental conditions within an enclosed space. Refrigeration systems are used for a variety of applications, such as in cold storage and warehouses, to cool stored items. For example, refrigeration systems may provide cooling operations for refrigerators and freezers.

SUMMARY

During low ambient conditions (e.g., ~35° F.), the condensing pressure of the refrigerant in and exiting the condenser of a refrigeration system is reduced, which causes a lower pressure differential across the expansion valve. In some instances, the low ambient condition lowers the pressure differential across the expansion valve such that the pressure differential is no longer sufficient to meet the demand of the refrigeration system. In these instances, the head pressure of the refrigeration system should be increased to compensate the lower pressure differential across the expansion valve.

This disclosure addresses the aforementioned problems by providing a refrigeration system that transitions from a normal mode of operation to a head pressure control mode of operation in response to detecting low ambient conditions. During the head pressure control mode, the refrigeration system increases the head pressure to compensate for the loss of pressure differential across the expansion valve. In some embodiments, the provided refrigeration system may include a condenser, a receiver tank, a heat exchanger, and a compressor. The condenser is configured to receive refrigerant from the compressor and the receiver tank is configured to receive the refrigerant from the condenser. The heat exchanger includes a first inlet configured to receive a first portion of the refrigerant from the receiver tank. The heat exchanger further includes a second inlet configured to receive the refrigerant from the compressor. A first valve is positioned between the compressor and the condenser. A second valve is positioned between the compressor and the second inlet to the heat exchanger.

During low ambient conditions, the provided refrigeration system operates in the head pressure control mode of operation, which includes closing the first valve and opening the second valve to direct the flow of refrigerant from the compressor to the second inlet of the heat exchanger. During the head pressure control mode of operation, heat is transferred in the heat exchanger between the refrigerant received from the compressor and the refrigerant received from the receiver tank. During heat transfer, at least a portion of the refrigerant received from the receiver tank transitions from a liquid refrigerant to a vapor refrigerant, and is discharged from a first outlet in the heat exchanger back to the receiver tank. The vapor refrigerant increases the pressure within the receiver tank and the pressure differential across an expansion valve positioned downstream of the receiver tank in the refrigeration system. In this way, the head pressure of the system can be controlled based on how much vapor refrigerant from the heat exchanger is recycled back to the receiver tank, which can be used to increase the pressure differential across the expansion valve to a desired value.

The systems and methods herein provide several practical applications and technical advantages. First, the provided systems and methods provide an improvement to the underlying technology by increasing the head pressure during low ambient conditions, which increases the differential pressure across the expansion valve to meet the demand of the refrigeration system. Second, in certain embodiments, the provided systems and methods are configured to increase the head pressure while operating with a continuous refrigerant flow through the refrigeration system. Additionally, the provided systems and methods may operate to increase the head pressure without flooding the condenser, which typically requires operating the refrigeration system with excess refrigerant, oversized equipment, and under non-continuous flow due to valve cycling. Further, oversized equipment may not be amendable for all refrigerants, such as A2L refrigerants, which have charge limitations. Accordingly, the provided systems and methods may provide the technical advantages of having smaller equipment with a lower capital cost and the option to maintain a desired head pressure under continuous flow conditions. Further, the provided systems and methods may operate with a lower refrigerant charge, which is amenable to a greater number of refrigerant types, including A2L refrigerants.

Certain embodiments of the present disclosure may include some, or none of these advantages. These advantages and other features will be more clearly understood from the following detailed description taken in conjunction with the accompanying drawings and claims.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
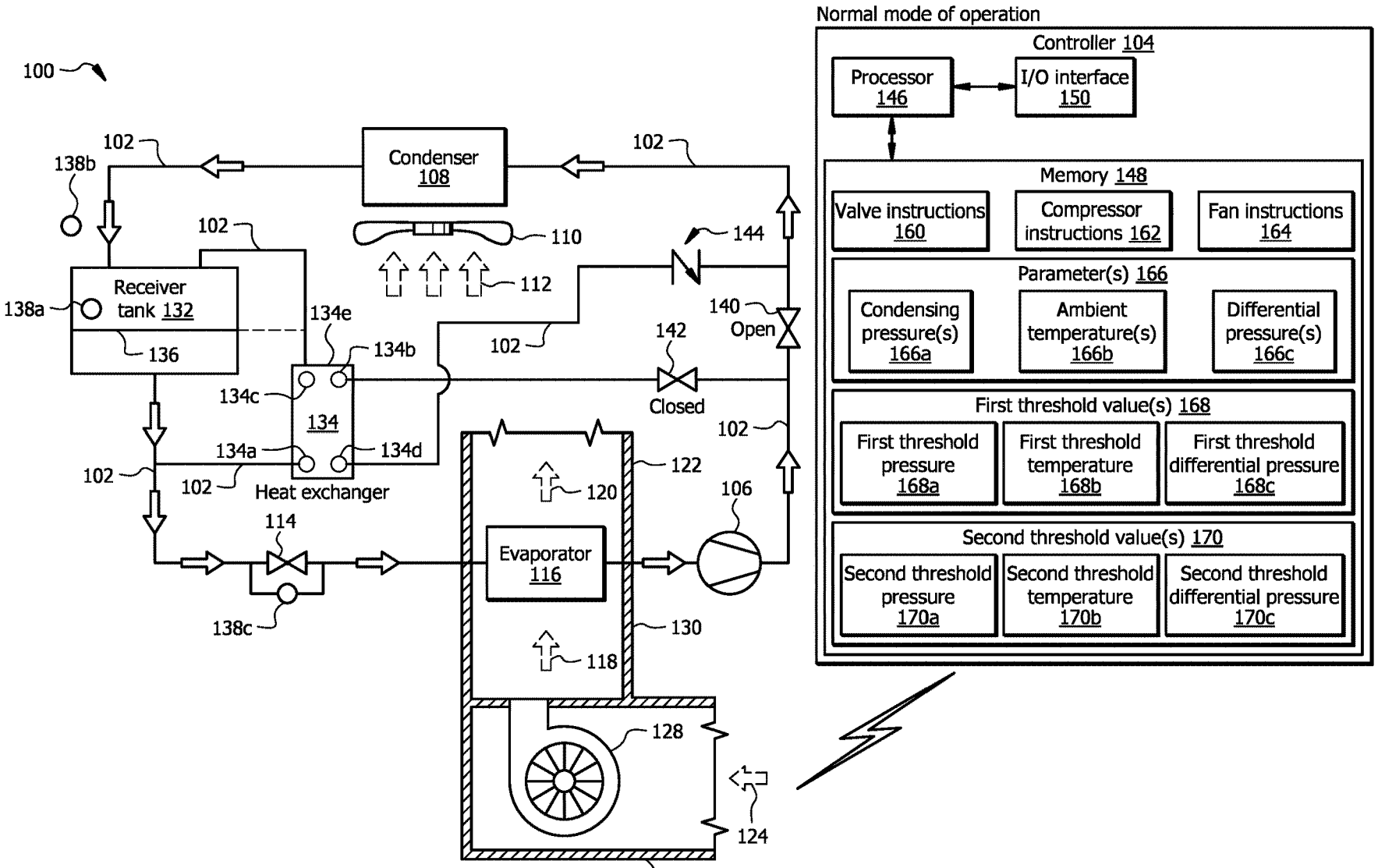
FIG. 1 is a diagram of a refrigeration system in a normal mode of operation according to some embodiments of the present disclosure.
Figure 2:
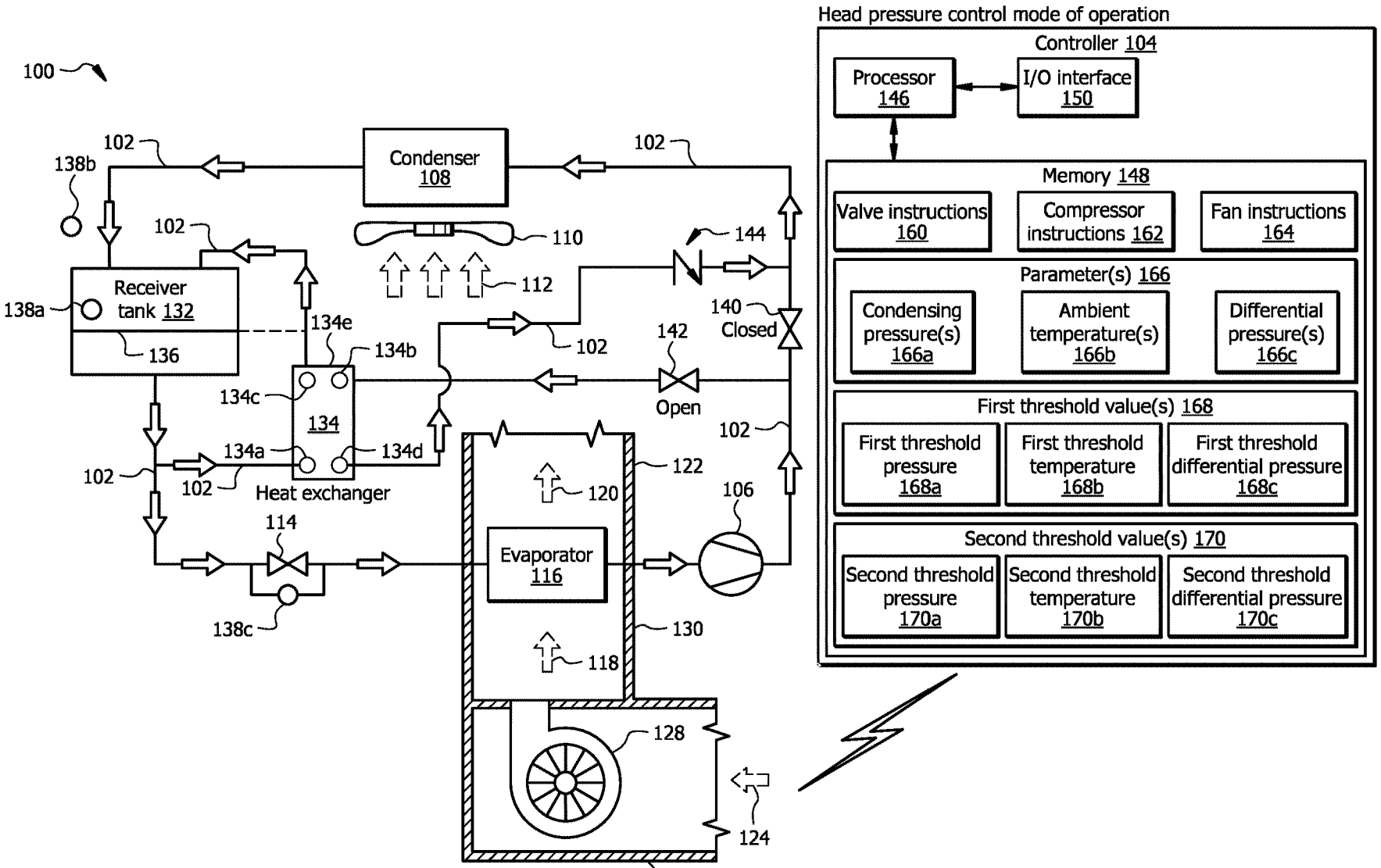
FIG. 2 is a diagram of the refrigeration system of FIG. 1 in a head pressure control mode of operation according to some embodiments of the present disclosure.
Figure 3:
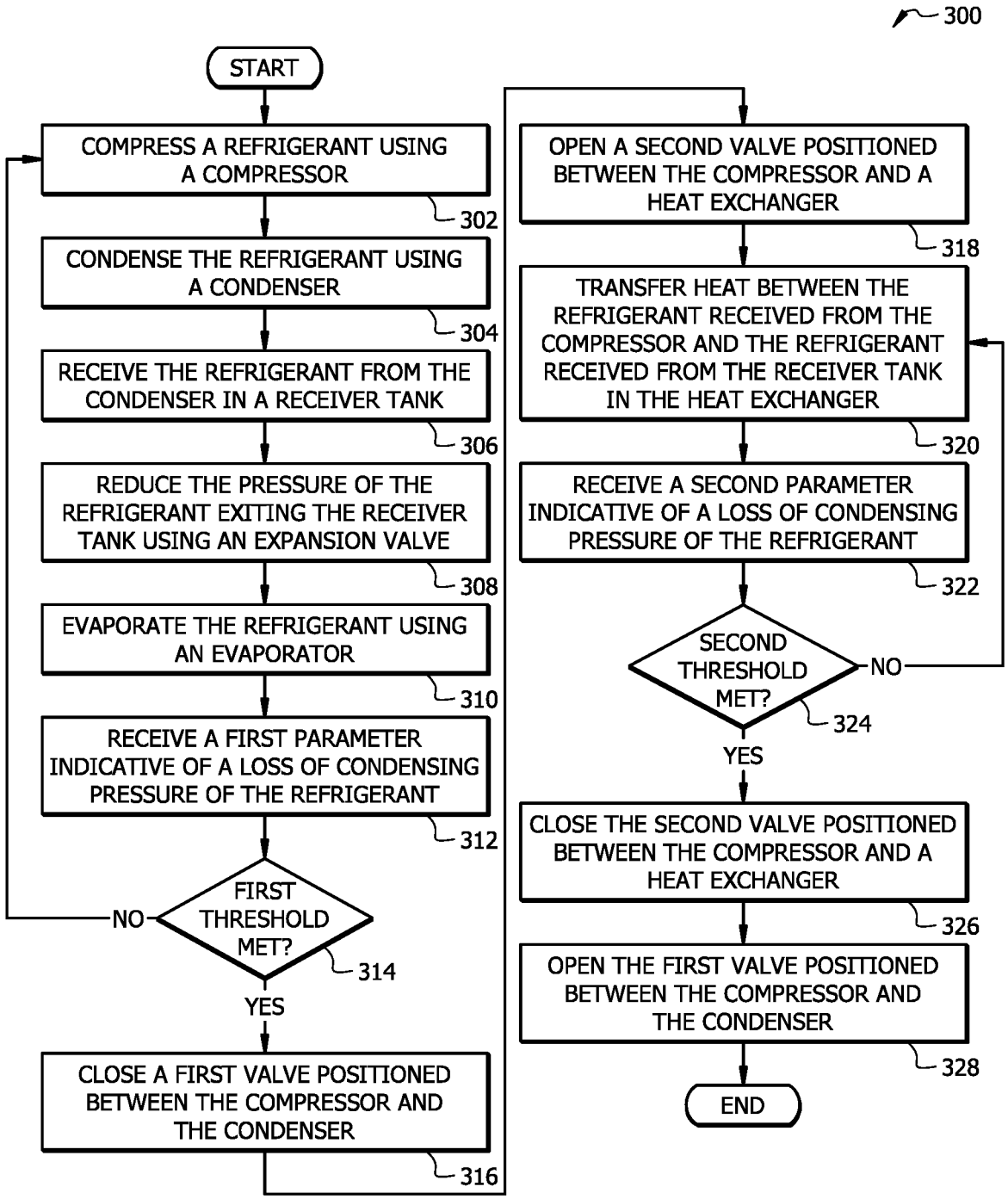
FIG. 3 is a flowchart of an example method of operating the refrigeration systems of FIGS. 1-2 according to some embodiments of the present disclosure.

Embodiments of the present disclosure and its advantages are best understood by referring to FIGS. 1 through 3 of the drawings, like numerals being used for like and corresponding parts of the various drawings.

During low ambient conditions (e.g., ~35° F.), the condensing pressure of the refrigerant in the condenser of a refrigeration system is reduced, which causes a lower pressure differential across the expansion valve. In some instances, the low ambient condition lowers the pressure differential across the expansion valve such that the pressure differential is no longer sufficient to meet the demand of the refrigeration system. In these instances, the head pressure of the refrigeration system should be increased to compensate the lower pressure differential across the expansion valve.

This disclosure addresses the aforementioned problems by providing a refrigeration system that transitions from a normal mode of operation to a head pressure control mode of operation in response to detecting low ambient conditions. During the head pressure control mode, the refrigeration system increases the head pressure to compensate for the loss of pressure differential across the expansion valve. In some embodiments, the provided HVAC system may include a condenser, a receiver tank, a heat exchanger, and a compressor. The condenser is configured to receive refrigerant from the compressor and the receiver tank is configured to receive the refrigerant from the condenser. The heat exchanger includes a first inlet configured to receive a first portion of the refrigerant from the receiver tank. The heat exchanger further includes a second inlet configured to receive the refrigerant from the compressor. A first valve is positioned between the compressor and the condenser. A second valve is positioned between the compressor and the second inlet to the heat exchanger.

During low ambient conditions, the provided refrigeration system operates in the head pressure control mode of operation, which includes closing the first valve and opening the second valve to direct the flow of refrigerant from the compressor to the second inlet of the heat exchanger. During the head pressure control mode of operation, heat is transferred in the heat exchanger between the refrigerant received from the compressor and the refrigerant received from the receiver tank. During heat transfer, at least a portion of the refrigerant received from the receiver tank transitions from a liquid refrigerant to a vapor refrigerant, and is discharged from a first outlet in the heat exchanger back to the receiver tank. The vapor refrigerant increases the pressure within the receiver tank and the pressure differential across an expansion valve positioned downstream of the receiver tank in the refrigeration system. In this way, the head pressure of the system can be controlled based on how much vapor refrigerant from the heat exchanger is recycled back to the receiver tank, which can be used to increase the pressure differential across the expansion valve to a desired value.

Refrigeration System

FIGS. 1-2 show an example refrigeration system 100 according to an embodiment of the present disclosure. FIG. 1 shows the refrigeration system 100 operating in a normal mode of operation, and FIG. 2 shows the refrigeration system 100 operating in a head pressure control mode of operation. The refrigeration system 100 conditions air for delivery to a conditioned space. The refrigeration system 100 may be used in a variety of applications including, but not limited to, cold storage applications, such as units coolers (e.g., walk in unit coolers, warehouse unit coolers, reach-in unit coolers), condensing units and packaged systems (e.g. air-cooled condensing units, packaged refrigeration systems, remote compressor units, water-cooled condensing units), condensers (e.g., air-cooled condensers), and refrigeration racks. The refrigeration system 100 may be configured as shown in FIGS. 1-2 or in any other suitable configuration. For example, the refrigeration system 100 may include additional components or may omit one or more components shown in FIG. 1-2.

In general, the refrigeration system 100 includes a working fluid conduit 102, a controller 104, a compressor 106, a condenser 108, a first air transport device 110, an expansion valve 114, an evaporator 116, a second air transport device 128, a receiver tank 132, a heat exchanger 134, one or more sensor **138*a*-138*c*, a first valve 140, a second valve 142, and a third valve 144. The controller 104 is communicatively coupled (e.g., via wired and/or wireless connection) to components in the refrigeration system 100 and configured to control their operation. The controller 104 includes a processor 146, a memory 148, and an input/output (I/O) interface 150**.

In some embodiments, the working fluid conduit 102 facilitates the movement of a working fluid (e.g., one or more refrigerants) through a cooling cycle such that the working fluid flows as illustrated by the arrows in FIGS. 1-2. The working fluid may be any acceptable working fluid including, but not limited to, fluorocarbons (e.g., chlorofluorocarbons), ammonia, non-halogenated hydrocarbons (e.g., propane), or hydrofluorocarbons (e.g., R-410A). In some embodiments, the working fluid comprises a mildly flammable A2L refrigerant.

The compressor 106 is coupled to the working fluid conduit 102 and compresses (i.e., increases the pressure) of the working fluid. The compressor 106 is in signal communication with the controller 104 using wired and/or wireless connection. The controller 104 provides commands and/or signals to control operation of the compressor 106 and/or receive signals from the compressor 106 corresponding to a status of the compressor 106. The compressor 106 may be a single-speed, variable-speed, or multiple stage compressor. A variable-speed compressor is generally configured to operate at different speeds to increase the pressure of the working fluid to keep the working fluid moving along the working fluid conduit 102. In the variable-speed compressor configuration, the speed of compressor 106 can be modified to adjust the cooling capacity of the refrigeration system 100. Meanwhile, in the multi-stage compressor configuration, one or more compressors can be turned on or off to adjust the cooling capacity of the refrigeration system 100.

The condenser 108 is configured to facilitate movement of the working fluid through the working fluid conduit 102. The condenser 108 is generally located downstream of the compressor 106 and is configured to remove heat from the working fluid. The condenser 108 is generally any heat exchanger configured to transfer heat between airflow 112 flowing across the condenser 108 and the refrigerant flowing through the condenser 108. The fan 110 is configured to move airflow 112 across the condenser 108 and one or more circuits of condenser coils in the condenser 108. For example, the fan 110 may be configured to blow outside air through the condenser 108 to help cool the working fluid flowing therethrough. The fan 110 may be in communication with the controller 104 (e.g., via wired and/or wireless communication) to receive control signals for turning the fan 110 on and off and/or adjusting a speed of the fan 110. The compressed, cooled working fluid flows from the condenser 108 toward the receiver tank 132.

The receiver tank 132 is fluidly coupled to the working fluid conduit 102 and is positioned downstream of the condenser 108. The receiver tank 132 is configured to receive and store at least a portion of the refrigerant. The refrigerant in the receiver tank 132 may comprise a liquid refrigerant and a vapor refrigerant. The vapor refrigerant collects near the top of the receiver tank 132 and the liquid refrigerant is collected at the bottom of the receiver tank 132. The liquid refrigerant may be present in the receiver tank 132 at a liquid level 136. The liquid refrigerant exits the receiver tank 132 via the working fluid conduit 102. A first portion of the liquid refrigerant exiting the receiver tank 132 is received by the heat exchanger 134 and a second portion of the liquid refrigerant exiting the receiver tank 132 is received by the expansion valve 114.

The heat exchanger 134 is fluidly coupled to the working fluid conduit 102 and positioned downstream of the receiver tank 132. The heat exchanger 134 comprises a first inlet 134*a* configured to receive the first portion of the refrigerant from the receiver tank 132. The heat exchanger 134 comprises a second inlet 134*b* positioned downstream of the compressor 106 that is configured to receive the refrigerant from the compressor 106. The heat exchanger 134 is configured to transfer heat between the refrigerant received from the compressor 106 and the refrigerant received from the receiver tank 132. The heat transfer causes at least a portion of the refrigerant received from the receiver tank 132 to transition from a liquid refrigerant to a vapor refrigerant. The heat exchanger 134 comprises a first outlet 134*c* that is in fluid communication with the first inlet 134*a* and configured to dispense the vapor refrigerant. The vapor refrigerant is discharged from the first outlet 134*c* and may be recycled to the receiver tank 132. Recycling the vapor refrigerant back to the receiver tank 132 increases the pressure of the receiver tank 132 and the head pressure of the refrigeration system 100. The heat exchanger 134 comprises a second outlet 134*d* positioned downstream of the second inlet 134*b*. The second outlet 134*d* in fluid communication with the second inlet 134*b*. The second outlet 134*d* is configured to dispense the refrigerant received from the compressor 106 to the condenser 108. Any suitable heat exchanger 134 may be used including, but not limited to, a shell-and-tube heat exchanger, plate heat exchanger, double-pipe heat exchanger, or combinations thereof. In some embodiments, the heat exchanger 134 has a flow arrangement that includes, but is not limited to, a parallel flow, a crossflow flow, or a countercurrent flow.

In some embodiments, a top end 134*e* of the heat exchanger 134 is positioned at or below the liquid level 136 of the refrigerant in the receiver tank 132. Positioning the top end 134*e* of the heat exchanger 134 at or below the liquid level 136 offers certain advantages. For example, positioning the top end 134*e* of the heat exchanger 134 at or below the liquid level 136 facilitates reducing, or otherwise eliminating, the production of a superheated vapor refrigerant. A "superheated vapor" may refer to a fluid in the vapor state that is heated to a temperature that is greater than the saturation temperature of the fluid at a given pressure. In some instances, if the top end 134*e* of the heat exchanger 134 is positioned above the liquid level 136, the heat exchanger 134 produces an increased amount of superheated vapor refrigerant, which may reduce the efficiency of the refrigeration system 100.

The expansion valve 114 is coupled to the working fluid conduit 102 downstream of the receiver tank 132 and is configured to reduce the pressure of the working fluid. In this way, the working fluid is delivered to the evaporator 116. In general, the expansion valve 114 may be a valve such as an expansion valve or a flow control valve (e.g., a thermostatic expansion valve (TXV)) or any other suitable valve for removing pressure from the working fluid while, optionally, providing control of the rate of flow of the working fluid. The expansion valve 114 may be in communication with the controller 104 (e.g., via wired and/or wireless communication) to receive control signals for opening and/or closing associated valves and/or to provide flow measurement signals corresponding to the rate of working fluid flow through the working fluid conduit 102.

The evaporator 116 is configured to facilitate movement of the working fluid through the working fluid conduit 102. The evaporator 116 is generally any heat exchanger configured to provide heat transfer between airflow 118 flowing across the evaporator 116 and working fluid passing through the interior of the evaporator 116. The evaporator 116 may include one or more circuits of evaporator coils that are configured to provide heat transfer between airflow 118 contacting an outer surface of one or more evaporator coils 194 and the working fluid flowing therethrough. The evaporator 116 is fluidically connected to the compressor 106, such that working fluid generally flows from the evaporator 116 to the compressor 106 when the refrigeration system 100 is operating to provide cooling.

A portion of the refrigeration system 100 is configured to move airflow 118 provided by the second air transport device 128 across the evaporator 116 and out of a duct system 122 as conditioned airflow 120. Return air 124, which may be air returning from the building, fresh air from outside, or some combination, is pulled into a return duct 126. A suction side of the second air transport device 128 pulls the return air 124. The blower 128 discharges and/or pulls the airflow 118 into a duct 130 such that the airflow 118 crosses the evaporator 116 to produce the conditioned airflow 120. The blower 128 may include any mechanism for providing the airflow 118 through the refrigeration system 100. For example, the blower 128 may be a constant speed or variable speed circulation blower or fan. Examples of a variable speed blower include, but are not limited to, belt-drive blowers controlled by inverters, direct-drive blowers with electronic commuted motors (ECM), or any other suitable type of blower. The blower 128 may be in communication with the controller 104 (e.g., via wired and/or wireless communication) to receive control signals for regulating the flowrate of the airflow 118.

The first valve 140 is coupled to the working fluid conduit 102 and positioned between the compressor 106 and the condenser 108. The first valve 140 may regulate the flow rate of the refrigerant from the compressor 106 to the condenser 108. The first valve 140 may be a controllable valve in communication with the controller 104 (e.g., via wired and/or wireless communication) to receive control signals for opening and/or closing to regulate the flow of the refrigerant.

The second valve 142 is coupled to the working fluid conduit 102 and positioned between the compressor 106 and the second inlet 134*b* of the heat exchanger 134. The second valve 142 may regulate the flow rate of the refrigerant from the compressor 106 to the second inlet 134*b* of the heat exchanger 134. The second valve 142 may be a controllable valve in communication with the controller 104 (e.g., via wired and/or wireless communication) to receive control signals for opening and/or closing to regulate the flow of the refrigerant.

The third valve 144 is coupled to the is coupled to the working fluid conduit 102 and positioned between the second outlet 134*d* of the heat exchanger 134 and the condenser 108. The third valve 144 may be a check valve that is configured to allow the flow of refrigerant from the second outlet 134*d* to the condenser 108 when a pressure difference across the check valve exceeds a threshold pressure (e.g., 1 to 5 psi). The check valve is a one-way valve that restricts, or otherwise prevents, the refrigerant from flowing out of the first valve to the second outlet 134*d* of the heat exchanger 134 during the normal mode of operation (i.e., restricts a backflow of the refrigerant).

The one or more sensors 138*a*-138*c* are configured to acquire one or more parameter 166 indicative of a loss of condensing pressure of the refrigerant. Exemplary parameters 166 that are indicative of a loss of condensing pressure of the refrigerant include, but are not limited to, a condensing pressure 166*a* of the refrigerant, an ambient temperature 166*b* of the air proximate the refrigeration system 100, a differential pressure 166*c* of the refrigerant across the expansion valve 114, or combinations thereof.

In some embodiments, the one or more sensors 138*a*-138*c* comprise a first sensor 138*a*. The first sensor 138*a* may be a pressure sensor configured to acquire a condensing pressure 166*a* of the refrigerant in or downstream of the condenser 108. In some embodiments, the first sensor 138*a* is positioned at a location between the condenser 108 and the expansion valve 114. In one non-limiting example, the first sensor 138*a* is positioned in the receiver tank 132 and is configured to acquire a condensing pressure of the refrigerant within the receiver tank 132. In some embodiments, the first sensor 138*a* is a temperature sensor configured to measure a saturation temperature of the refrigerant in or downstream of the condenser 108. A "saturated liquid" is said to be at the saturation temperature for a given pressure. If the temperature of a saturated liquid is increased above the saturation temperature, the saturated liquid generally begins to vaporize. When the first sensor 138*a* is a temperature sensor, the condensing pressure for the saturated refrigerant can be measured indirectly via a measure of the saturation temperature. For example, the saturation temperature may be converted to the condensing pressure using a pressure-temperature chart for a given refrigerant.

In some embodiments, the one or more sensors 138*a*-138*c* comprise a second sensor 138*b*. The second sensor 138*b* may be a temperature sensor configured to acquire an ambient temperature 166*b*. For example, the temperature sensor may be configured to acquire the ambient temperature 164*b* proximate the refrigeration system 100. In some embodiments, the second sensor 138*b* a temperature sensor such as a thermocouple or a thermistor.

In some embodiments, the one or more sensors 138*a*-138*c* comprise a third sensor 138*c*. The third sensor 138*c* may be one or more pressure sensor configured to acquire a differential pressure 166*c* of the refrigerant across the expansion valve 114. For example, the pressure sensor may be configured to receive a first pressure measurement upstream of the expansion valve 114 and a second pressure measurement downstream of the expansion valve 114, where the differential pressure 166*c* across the expansion valve 114 is a difference between the first pressure measurement and the second pressure measurement.

The controller 104 is communicatively coupled (e.g., via wired and/or wireless connection) to components in the refrigeration system 100 and configured to control their operation. In some embodiments, controller 104 can be one or more controllers associated with one or more components of the refrigeration system 100. The controller 104 includes a processor 146, memory 148, and an input/output (I/O) interface 150.

The processor 146 comprises one or more processors operably coupled to the memory 148. The processor 146 is any electronic circuitry including, but not limited to, state machines, one or more central processing unit (CPU) chips, logic units, cores (e.g., a multi-core processor), field-programmable gate array (FPGAs), application specific integrated circuits (ASICs), or digital signal processors (DSPs) that communicatively couples to memory 148 and controls the operation of refrigeration system 100. The processor 146 may be a programmable logic device, a microcontroller, a microprocessor, or any suitable combination of the preceding. The processor 146 is communicatively coupled to and in signal communication with the memory 148. The one or more processors are configured to process data and may be implemented in hardware or software. For example, the processor 146 may be 8-bit, 16-bit, 32-bit, 64-bit or of any other suitable architecture. The processor 146 may include an arithmetic logic unit (ALU) for performing arithmetic and logic operations, processor registers that supply operands to the ALU and store the results of ALU operations, and a control unit that fetches instructions from memory 148 and executes them by directing the coordinated operations of the ALU, registers, and other components. The processor 146 may include other hardware and software that operates to process information, control the refrigeration system 100, and perform any of the functions described herein. The processor 146 is not limited to a single processing device and may encompass multiple processing devices.

The memory 148 includes one or more disks, tape drives, or solid-state drives, and may be used as an over-flow data storage device, to store programs when such programs are selected for execution, and to store instructions and data that are read during program execution. The memory 148 may be volatile or non-volatile and may comprise ROM, RAM, ternary content-addressable memory (TCAM), dynamic random-access memory (DRAM), and static random-access memory (SRAM). The memory 148 is operable to store any suitable set of instructions, logic, rules, and/or code for executing the functions described in this disclosure. For example, the memory 148 may store valve instructions 160, compressor instructions 162, fan instructions 164, one or more parameters 166 acquired by the one or more sensors 138*a*-138*c* (e.g., a condensing pressure 166*a*, an ambient temperature 166*b*, a differential pressure 166*c*), a first threshold value 168 (e.g., a first threshold pressure 168*a*, a first threshold temperature 168*b*, a first threshold differential pressure 168*c*), and a second threshold value 170 (e.g., a second threshold pressure 170*a*, a second threshold temperature 170*b*, a second threshold differential pressure 170*c*).

The I/O interface 150 is configured to communicate data and signals with other devices. For example, the I/O interface 150 may be configured to communicate electrical signals with the other components of the refrigeration system 100. The I/O interface 150 may comprise ports and/or terminals for establishing signal communications between the controller 104 and other devices. The I/O interface 150 may be configured to enable wired and/or wireless communications. Connections between various components of the refrigeration system 100 and between components of the refrigeration system 100 may be wired or wireless. For example, conventional cable and contacts may be used to couple the various components of the refrigeration system 100, including, the compressor 106, the fan 110, the expansion valve 114, the blower 128, the one or more sensors 138*a*-138*c*, the first valve 140, and the second valve 142. In some embodiments, a data bus couples various components of the refrigeration system 100 together such that data is communicated there between. In a typical embodiment, the data bus may include, for example, any combination of hardware, software embedded in a computer readable medium, or encoded logic incorporated in hardware or otherwise stored (e.g., firmware) to couple components of the refrigeration system 100 to each other.

Referring to FIG. 1, the refrigeration system 100 is illustrated while operating in a normal mode of operation. In the normal mode of operation, the first valve 140 is open and the second valve 142 is closed such that the refrigerant flows through the cooling cycle as illustrated by the arrows in FIG. 1. In some embodiments, during the normal mode of operation, the controller 104 may receive from the one or more sensors 138*a*-138*c* a parameter 166 indicative of a loss of condensing pressure in the refrigeration system 100. The controller 104 may determine using the processor 146 that the refrigeration system 100 should operate in a head pressure control mode of operation if the parameter 166 indicative of the loss of condensing pressure is equal to or less than one or more threshold values 168. For example, the controller 104 may receive a condensing pressure 168*a* of the refrigerant from the first sensor 138*a*, and determine that the refrigeration system 100 should operate in the head pressure control mode of operation if the condensing pressure is equal to or less than a threshold pressure 168*a* (e.g., less than 300 psig). Additionally, or alternatively, the controller 104 may receive an ambient temperature 168*b* from the second sensor 138*b* and determine that the refrigeration system 100 should operate in the head pressure control mode of operation if the ambient temperature 168*b* is equal to or less than a threshold temperature 168*b* (e.g., less than 35° F.). Additionally, or alternatively, the controller 104 may receive a differential pressure 168*c* from the third sensor 138*c* and determine that the refrigeration system 100 should operate in the head pressure control mode of operation if the differential pressure 168*c* is equal to or less than a threshold differential pressure (e.g., 100 psig).

Referring to FIG. 2, the refrigeration system 100 is illustrated while operating in the head pressure control mode of operation. In response to determining that the refrigeration system 100 should operate in the head pressure control mode of operation, the controller 104 is configured to close the first valve 140 and open the second valve 142 such that the refrigerant flows through the cooling cycle as illustrated by the arrows in FIG. 2. Closing the first valve 140 and opening the second valve 142 directs the refrigerant from the compressor 106 to the second inlet 134*b* of the heat exchanger 134. As discussed above, the heat exchanger 134 is configured to transfer heat between the refrigerant received from the compressor 106 and the refrigerant received from the receiver tank 132. The transfer of heat causes at least a portion of the refrigerant received from the receiver tank 132 to transition from a liquid refrigerant to a vapor refrigerant. The vapor refrigerant is dispensed from the first outlet 134*c* back to the receiver tank 132, which causes the pressure of the receiver tank 132 to increase. The refrigerant received from the compressor 106 is dispensed out of the second outlet 134*d* of the heat exchanger and is directed towards the third valve 144. In the instance where the third valve 144 is a check valve, the flow of refrigerant exiting the second outlet 134*d* causes the pressure difference across the check valve to exceed a threshold pressure (e.g., 1 to 5 psi), which in turn opens the check valve allowing the refrigerant to flow from the second outlet 134*d* of the heat exchanger 134 to the condenser 108.

The controller 104 may be configured to transition the refrigeration system 100 from operating in the head pressure control mode of operation (FIG. 2) back to the normal mode of operation (FIG. 1). For example, the controller 104 may receive a second parameter 166 indicative of the condensing pressure from the one or more sensors 138*a*-138*c*. The controller 104 may compare the second parameter 166 to the second threshold value 170 stored in the memory 148 to determine if the refrigeration system 100 should transition from the head pressure control mode of operation back to the normal mode of operation. For example, the second threshold value 170 may include a second threshold pressure 170*a*, a second threshold temperature 170*b*, or a second threshold differential pressure 170*c* that is greater than the respective first threshold value 168 by a predetermined margin (e.g., at least 5% greater, at least 10% greater, at least 15% greater, to less than 25% greater, or less than 50% greater). The controller 104 may determine that the refrigeration system 100 should operate in the normal mode of operation if the second parameter 166 is greater than the second threshold value 170. In response to determining that the second parameter 166 is greater than the second threshold value 170, the controller 104 is configured to open the first valve 140 and close the second valve 142 to resume the normal mode of operation depicted in FIG. 1.

Example Operation

FIG. 3 illustrates an example operational flow 300 of operating the refrigeration system 100 of FIGS. 1-2. The operational flow can logically be described in three parts. The first part includes operating the refrigeration system 100 in a normal mode of operation, which includes operations 302-310. In some embodiments, operations 302-310 generally include compressing a refrigerant with the compressor 106, condensing the refrigerant using the condenser 108, receiving the refrigerant in the receiver tank 132, reducing the pressure of the refrigerant exiting the receiver tank 132 using the expansion valve 114, and evaporating the refrigerant using the refrigerant using the evaporator 116.

The second part includes determining whether the refrigeration system 100 should transition from the normal mode of operation to the head pressure control mode of operation. The second part includes operations 312-320, which generally includes receiving a parameter 166 indicative of a loss of condensing pressure of the refrigerant from one or more sensor 138*a*-138*c*, determining with the controller 104 that the refrigeration system 100 should operate in the head pressure control mode of operation if the parameter 166 indicative of the condensing pressure is equal to or less than a first threshold value 168. In response to determining that the refrigeration system 100 should operate in the head pressure control mode of operation, the second part further includes using the controller 104 to close the first valve 140 positioned between the compressor 106 and the condenser 108 and open the second valve 142 positioned between the compressor 106 and the second inlet 134*b* of the heat exchanger 134. Closing the first valve 140 and opening the second valve 142 directs the refrigerant from the compressor 106 to the second inlet 134*b* of the heat exchanger 134. The heat exchanger 134 is configured to transfer heat between the refrigerant received from the compressor 106 and the refrigerant received from the receiver tank 132. The transfer of heat causes at least a portion of the refrigerant received from the receiver tank to transition from a liquid refrigerant to a vapor refrigerant. The vapor refrigerant is dispensed from the first outlet 134*c* of the heat exchanger 134 and is recycled back to the receiver tank 132 to increase the pressure of the receiver tank 132.

The third part includes determining whether the refrigeration system 100 should transition from the head pressure control mode of operation back to the normal mode of operation. The third part includes operations 322-328, which generally includes receiving a second parameter 166 indicative of the condensing pressure from the one or more sensors 138*a*-138*c*, determining if the second parameter 166 indicative of the condensing pressure is greater than a second threshold value 170, and if the second parameter 166 indicative of the condensing pressure is greater than the second threshold value 170, the controller 104 is configured to transition the operation of the refrigeration system 100 from the head pressure control mode of operation to the normal mode of operation. Transitioning back to the normal mode of operating includes using the controller 104 to open the first valve 140 and close the second valve 142.

At operation 302, the operational flow 300 includes compressing the refrigerant using the compressor 106 in a normal mode of operation (e.g., FIG. 1). For example, the compressor 106 may receive refrigerant from the evaporator 116 via the working fluid conduit 102. The compressor 106 may compress the refrigerant and transport the refrigerant to the condenser 108 via the working fluid conduit 102. At operation 304, the operational flow 300 includes condensing the refrigerant by transferring heat between the airflow 112 flowing across the condenser 108 and the refrigerant flowing through the condenser 108.

At operation 306, the operational flow 300 includes receiving the refrigerant in the receiver tank 132 from the condenser 108. The receiver tank 132 is configured to receive and store at least a portion of the refrigerant. The refrigerant in the receiver tank 132 may comprise a liquid refrigerant and a vapor refrigerant. The liquid refrigerant exits the receiver tank 132 via the working fluid conduit 102. A first portion of the liquid refrigerant exiting the receiver tank 132 is received by the heat exchanger 134 and a second portion of the liquid refrigerant exiting the receiver tank 132 is received by the expansion valve 114.

At operation 308, the operational flow 300 includes reducing the pressure of the refrigerant using the expansion valve 114. The expansion valve 114 may be in communication with the controller 104 (e.g., via wired and/or wireless communication) to receive control signals for opening and/or closing associated valves and/or to provide flow measurement signals corresponding to the rate of the refrigerant flowing through the working fluid conduit 102. At operation 310, the operational flow 300 includes evaporating the refrigerant received from the expansion valve 114 using the evaporator 116. For example, operation 310 may include transferring heat between airflow 118 flowing across the evaporator 116 and refrigerant flowing through the evaporator 116 to produce a conditioned airflow 120 that is delivered to a target space.

At operation 312, the operational flow 300 includes receiving a first parameter 166 indicative of a loss of condensing pressure on the controller 104 from one or more sensor 138*a*-138*c*. For example, the controller 104 may receive a condensing pressure 166*a* from the first sensor 138*a*, an ambient temperature 166*b* from the second sensor 138*b*, and/or a differential pressure 166*c* form the third sensor 138*c*. At decision block 314, the operational flow 300 includes determining using the controller 104 whether the refrigeration system 100 should operate in a head pressure control mode (e.g., FIG. 2) if the first parameter 166 indicative of the loss of condensing pressure is equal to or less than one or more threshold value 168. For example, the controller 104 may receive a condensing pressure 168*a* of the refrigerant from the first sensor 138*a*, and determine that the refrigeration system 100 should operate in the head pressure control mode of operation if the condensing pressure is equal to or less than a threshold pressure 168*a* (e.g., less than 300 psig). Additionally, or alternatively, the controller 104 may receive an ambient temperature 168*b* from the second sensor 138*b* and determine that the refrigeration system 100 should operate in the head pressure control mode of operation if the ambient temperature 168*b* is equal to or less than a threshold temperature 168*b* (e.g., less than 35° F.). Additionally, or alternatively, the controller 104 may receive a differential pressure 168*c* from the third sensor 138*c* and determine that the refrigeration system 100 should operate in the head pressure control mode of operation if the differential pressure 168*c* is equal to or less than a threshold differential pressure (e.g., 100 psig). If the first parameter 166 indicative of the loss of condensing pressure is greater than the first threshold value 168, the operational flow 300 proceeds to operation 316. If the first parameter 166 indicative of the loss of condensing pressure is less than the first threshold value 168, the operational flow 300 returns to operation 302.

In response to determining that the first parameter 166 indicative of the loss of condensing pressure is less than the first threshold value 168, the operational flow 300 includes proceeding to operations 316-318, which includes closing the first valve 140 and opening the second valve 142 such that refrigerant flows through the cooling cycle illustrated in FIG. 2. Closing the first valve 140 and opening the second valve 142 directs the refrigerant from the compressor 106 to the second inlet 134*b* of the heat exchanger 134.

At operation 320, the heat exchanger 134 is configured to transfer heat between the refrigerant received from the compressor 106 and the refrigerant received from the receiver tank 132. The transfer of heat causes at least a portion of the refrigerant received from the receiver tank 132 to transition from a liquid refrigerant to a vapor refrigerant. The vapor refrigerant is dispensed from the first outlet 134*c* back to the receiver tank 132, which causes the pressure of the receiver tank 132 to increase. The refrigerant received from the compressor 106 is dispensed out of the second outlet 134*d* of the heat exchanger and is directed towards the third valve 144. In the instance where the third valve 144 is a check valve, the flow of refrigerant exiting the second outlet 134*d* causes the pressure difference across the check valve to exceed a threshold pressure (e.g., 1 to 5 psi), which in turn opens the check valve allowing the refrigerant to flow from the second outlet 134*d* of the heat exchanger 134 to the condenser 108.

The controller 104 may be configured to transition the refrigeration system 100 from operating in the head pressure control mode of operation (FIG. 2) back to the normal mode of operation (FIG. 1). For example, at operation 322, the controller 104 may receive a second parameter 166 indicative of the condensing pressure from the one or more sensors 138*a*-138*c*. At decision block 324, the controller 104 may compare the second parameter 166 to the second threshold value 170 stored in the memory 148 to determine if the refrigeration system 100 should transition from the head pressure control mode of operation back to the normal mode of operation. For example, the second threshold value 170 may include a second threshold pressure 170*a*, a second threshold temperature 170*b*, or a second threshold differential pressure 170*c* that is greater than the respective first threshold value 168 by a predetermined margin (e.g., at least 5% greater, at least 10% greater, at least 15% greater, to less than 25% greater, or less than 50% greater). If the second parameter 166 indicative of the loss of condensing pressure is less than the second threshold value 170, then the operational flow may return to operation 320 to continue operating in the head pressure control mode of operation. If the second parameter 166 indicative of the loss of condensing pressure is greater than the second threshold value 170, the controller 104 in response may transition the refrigeration system 100 to transition from the head pressure control mode of operation back to the normal mode of operation. For example, at operations 326-328, the operational flow 300 includes opening the first valve 140 and closing the second valve 142 to resume the normal mode of operation depicted in FIG. 1.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A refrigeration system, the refrigeration system comprising:

a compressor configured to receive a refrigerant;

a condenser positioned downstream of the compressor;

a receiver tank positioned downstream of the condenser;

a heat exchanger comprising:

a first inlet positioned downstream of the receiver tank;

a second inlet positioned downstream of the compressor, the heat exchanger configured to transfer heat between the refrigerant received from the compressor and the refrigerant received from the receiver tank, wherein a transfer of heat causes at least a portion of the refrigerant received from the receiver tank to transition from a liquid refrigerant to a vapor refrigerant;

a first outlet in fluid communication with the first inlet, the first outlet configured to dispense the vapor refrigerant toward the receiver tank;

a second outlet in fluid communication with the second inlet and configured to dispense the refrigerant received from the compressor toward the condenser;

a first valve positioned between the compressor and the condenser, the first valve configured to regulate a flow of refrigerant from the compressor to the condenser; and a second valve positioned downstream of the compressor and upstream of the second inlet of the heat exchanger, the second valve configured to regulate the flow of the refrigerant from the compressor to the second inlet of the heat exchanger.

2. The refrigeration system of claim 1 further comprising:

an expansion valve positioned downstream of the receiver tank; and an evaporator positioned downstream of the expansion valve, wherein the compressor is configured downstream of the evaporator.

3. The refrigeration system of claim 1 further comprising:

a check valve positioned between the second outlet of the heat exchanger and the condenser, wherein the check valve is configured to restrict the refrigerant from flowing between the first valve to the second outlet of the heat exchanger.

4. The refrigeration system of claim 1, wherein the receiver tank further comprises the refrigerant and the refrigerant is present in the receiver tank at a liquid level, and wherein a top end of the heat exchanger is positioned below the liquid level in the receiver tank.

5. The refrigeration system of claim 1 further comprising:

a sensor configured to acquire a parameter indicative of a loss of condensing pressure;

a controller comprising a memory and a processor, the memory operable to store a threshold value, the processor operatively coupled to the memory and configured to:

receive, from the sensor, the parameter indicative of the condensing pressure;

determine that the refrigeration system should operate in a head pressure control mode of operation if the parameter is equal to or less than a threshold value, wherein during the head pressure control mode of operation, the controller is configured to:

close the first valve;

open the second valve;

wherein closing the first valve and opening the second valve directs the refrigerant from the compressor to the second inlet of the heat exchanger, wherein the vapor refrigerant dispensed from the first outlet of the heat exchanger causes a pressure of the receiver tank to increase.

6. The refrigeration system of claim 5, wherein the memory is operable to store a second threshold value, wherein the second threshold value is greater than the threshold value; and wherein the processor is further configured to:

receive, from the sensor, a second parameter indicative of the condensing pressure;

determine that the refrigeration system should operate in a normal mode of operation if the second parameter is greater than the second threshold value, wherein during the normal mode of operation, the processor is configured to:

open the first valve; and close the second valve.

7. The refrigeration system of claim 5, wherein the sensor comprises a pressure sensor configured to acquire a condensing pressure of the refrigerant in or downstream of the condenser, wherein the parameter indicative of the loss of condensing pressure comprises the condensing pressure of the refrigerant; and wherein the controller is configured to:

receive, from the pressure sensor, the condensing pressure;

determine that the refrigeration system should operate in the head pressure control mode of operation if the condensing pressure is equal to or less than the threshold value, and wherein the threshold value is a threshold pressure.

8. The refrigeration system of claim 5, wherein the sensor comprises a temperature sensor configured to acquire an ambient temperature proximate to the refrigeration system, and wherein the parameter indicative of the loss of condensing pressure comprises the ambient temperature; and wherein the controller is configured to:

receive, from the temperature sensor, the ambient temperature;

determine that the refrigeration system should operate in the head pressure control mode of operation if the ambient temperature is equal to or less than the threshold value, and wherein the threshold value is a threshold temperature.

9. The refrigeration system of claim 5 further comprising:

an expansion valve positioned downstream of the receiver tank and configured to receive a second portion of the refrigerant from the receiver tank;

wherein the sensor comprises at least one pressure sensor configured to acquire a differential pressure of the refrigerant across the expansion valve, and wherein the parameter indicative of the loss of condensing pressure comprises the differential pressure of the refrigerant; and wherein the controller is configured to:

receive, from the at least one pressure sensor, the differential pressure across the expansion valve;

determine that the refrigeration system should operate in the head pressure control mode of operation if the differential pressure is equal to or less than the threshold value, wherein the threshold value is a differential pressure threshold.

10. A method of operating a refrigeration system, the method comprising:

compressing, using a compressor, a refrigerant to a condenser;

condensing the refrigerant using the condenser;

receiving the refrigerant exiting the condenser in a receiver tank, wherein a first inlet to a heat exchanger is configured to receive a portion of the refrigerant from the receiver tank;

receiving, on a controller, a parameter indicative of a loss of condensing pressure from one or more sensor; and determining, using the controller, that the refrigeration system should operate in a head pressure control mode of operation if the parameter is equal to or less than a first threshold value, wherein during the head pressure control mode of operation, the controller is configured to:

close a first valve positioned between the compressor and the condenser;

open a second valve positioned between the compressor and a second inlet to the heat exchanger;

wherein closing the first valve and opening the second valve directs the refrigerant from the compressor to the second inlet of the heat exchanger, wherein the heat exchanger is configured to transfer heat between the refrigerant received from the compressor and the refrigerant received from the receiver tank, wherein a transfer of heat causes at least a portion of the refrigerant received from the receiver tank to transition from a liquid refrigerant to a vapor refrigerant, and wherein the vapor refrigerant is dispensed from a first outlet of the heat exchanger and is recycled back to the receiver tank to increase a pressure of the receiver tank.

11. The method of claim 10, further comprising:

reducing the pressure of a second portion of the refrigerant exiting the receiver tank using an expansion valve; and evaporating the refrigerant received from the expansion valve using an evaporator, wherein the compressor is configured to receive the refrigerant from the evaporator.

12. The method of claim 10, wherein during the head pressure control mode of operation, the method further comprises:

receiving the refrigerant exiting a second outlet in the heat exchanger in a check valve positioned between the second outlet of the heat exchanger and the condenser, wherein during a normal mode of operation the check valve restricts the refrigerant from flowing between the first valve to the second outlet of the heat exchanger.

13. The method of claim 10 further comprising:

receiving, on the controller, a second parameter indicative of the loss of condensing pressure from the one or more sensor;

determining that the refrigeration system should operate in a normal mode of operation if the second parameter is greater than a second threshold value that is greater than the first threshold value, wherein during the normal mode of operation, the controller is configured to:

open the first valve; and close the second valve.

14. The method of claim 10, wherein the sensor comprises a pressure sensor configured to acquire a condensing pressure of the refrigerant in or downstream of the condenser, wherein the parameter indicative of the loss of condensing pressure comprises the condensing pressure of the refrigerant; and wherein the controller is configured to:

receive, from the pressure sensor, the condensing pressure;

determine that the refrigeration system should operate in the head pressure control mode of operation if the condensing pressure is equal to or less than the first threshold value, and wherein the first threshold value is a threshold pressure.

15. The method of claim 10, wherein the sensor comprises a temperature sensor configured to acquire an ambient temperature proximate to the refrigeration system, and wherein the parameter indicative of the loss of condensing pressure comprises the ambient temperature; and wherein the controller is configured to:

receive, from the temperature sensor, the ambient temperature;

determine that the refrigeration system should operate in a head pressure control mode of operation if the ambient temperature is equal to or less than the first threshold value, and wherein the first threshold value is a temperature threshold.

16. The method of claim 10 further comprising:

reducing the pressure of a second portion of the refrigerant exiting the receiver tank using an expansion valve; and wherein the one or more sensors comprises at least one pressure sensor configured to acquire a differential pressure of the refrigerant across the expansion valve, and wherein the parameter indicative of the loss of condensing pressure comprises the differential pressure of the refrigerant; and wherein the controller is configured to:

receive, from the at least one pressure sensor, the differential pressure across the expansion valve;

determine that the refrigeration system should operate in a head pressure control mode of operation if the differential pressure is equal to or less than the first threshold value, wherein the first threshold value is a differential pressure threshold.

17. A controller of a refrigeration system, the controller comprising:

a memory operable to store a threshold value, a processor operatively coupled to the memory and configured to:

turn on a compressor to compress a refrigerant to a condenser, wherein the refrigerant exiting the condenser is received by a receiver tank, and a first inlet to a heat exchanger is configured to receive the refrigerant from the receiver tank;

receive, from one or more sensors, a parameter indicative of a loss of condensing pressure;

determine, using the processor, that the refrigeration system should operate in a head pressure control mode of operation if the parameter is equal to or less than a threshold value, wherein during the head pressure control mode of operation, the controller is configured to:

close a first valve positioned downstream of the compressor and upstream of the condenser;

open a second valve positioned downstream of the compressor and upstream of a second inlet to the heat exchanger;

wherein closing the first valve and opening the second valve directs the refrigerant from the compressor to the second inlet of the heat exchanger, wherein the heat exchanger is configured to transfer heat between the refrigerant received from the compressor and the refrigerant received from the receiver tank, wherein a transfer of heat causes at least a portion of the refrigerant received from the receiver tank to transition from a liquid refrigerant to a vapor refrigerant, and wherein the vapor refrigerant is dispensed from a first outlet of the heat exchanger and is recycled back to the receiver tank to increase a pressure of the receiver tank.

18. The controller of claim 17, wherein the one or more sensors comprises a pressure sensor configured to acquire a condensing pressure of the refrigerant in or downstream of the condenser, wherein the parameter indicative of the loss of condensing pressure comprises the condensing pressure of the refrigerant; and wherein the controller is configured to:

receive, from the pressure sensor, the condensing pressure;

determine that the refrigeration system should operate in the head pressure control mode of operation if the condensing pressure is equal to or less than the threshold value, and wherein the threshold value is a threshold pressure.

19. The controller of claim 17, wherein the one or more sensors comprises a temperature sensor configured to acquire an ambient temperature proximate to the refrigeration system, and wherein the parameter indicative of the loss of condensing pressure comprises the ambient temperature; and wherein the controller is configured to:

receive, from the temperature sensor, the ambient temperature;

determine that the refrigeration system should operate in the head pressure control mode of operation if the ambient temperature is equal to or less than the threshold value, and wherein the threshold value is a temperature threshold.

20. The controller of claim 17, wherein an expansion valve is positioned downstream of the receiver tank and configured to receive a second portion of the refrigerant from the receiver tank;

wherein the one or more sensors comprises at least one pressure sensor configured to acquire a differential pressure of the refrigerant across the expansion valve, and wherein the parameter indicative of the loss of condensing pressure comprises the differential pressure of the refrigerant; and wherein the controller is configured to:

receive, from the at least one pressure sensor, the differential pressure across the expansion valve;

determine that the refrigeration system should operate in the head pressure control mode of operation if the differential pressure is equal to or less than the threshold value, wherein the threshold value is a differential pressure threshold.

* * * * *